US005894254A

United States Patent [19]

Reiter et al.

[11] Patent Number: 5,894,254

[45] Date of Patent: Apr. 13, 1999

[54] ELECTROMAGNETIC RELAY

[75] Inventors: Klaus Reiter, Waidhofen; Zoran Gmajner, Wien; Ernst Bittermann, Schrems, all of Austria

[73] Assignee: EH Schrack Components AG, Vienna, Austria

[21] Appl. No.: 09/061,523

[22] Filed: Apr. 16, 1998

[30] Foreign Application Priority Data

Apr. 16, 1997 [DE] Germany ..... 197 15 913

[51] Int. Cl.[6] ..... H01H 51/22

[52] U.S. Cl. ..... 335/80; 335/78; 335/128; 335/129; 335/130; 335/131; 335/81; 335/82; 335/83; 335/84; 335/85; 335/86

[58] Field of Search ..... 335/78–86, 128, 335/129, 130, 131

[56] References Cited

U.S. PATENT DOCUMENTS

| | | | |
|---|---|---|---|
| 4,914,410 | 4/1990 | Diem et al. | 335/80 |
| 5,084,688 | 1/1992 | Martino | 335/78 |
| 5,202,663 | 4/1993 | Tomono et al. | 335/86 |
| 5,734,308 | 3/1998 | Dittmann et al. | 335/78 |

FOREIGN PATENT DOCUMENTS

| | | |
|---|---|---|
| 0 319 478 B1 | 11/1988 | European Pat. Off. . |
| 1 764 256 | 5/1968 | Germany . |
| 1 764 507 | 6/1968 | Germany . |
| 1 908 269 | 2/1969 | Germany . |
| 25 17 632 | 4/1976 | Germany . |

*Primary Examiner*—Michael L. Gellner
*Assistant Examiner*—Tuyen T. Nguyen
*Attorney, Agent, or Firm*—Hill & Simpson

[57] ABSTRACT

A relay is formed by a magnet system containing a wound coil body, an L-shaped core arranged axially therein, an L-shaped armature and a base element with terminal elements. Stationary and moving contact elements are arranged between the base element and the magnet system. The armature is mounted with the free end of its transverse leg at the free end of the longitudinal leg of the core. The armature is secured through a U-shaped armature spring wrapping around the armature. The spring is secured with one arm at the longitudinal leg of the armature and a second arm is inserted in a recess between the coil body and the core. The actuation of the moving contact elements is provided via a slide coupled to the armature. This slide is hooked to the armature by spring tabs of the armature spring at opposing sides of the armature through snap latches formed at the ends of the side arms of the slide.

20 Claims, 3 Drawing Sheets

ELECTROMAGNETIC RELAY

BACKGROUND OF THE INVENTION

Field of the Invention

The present invention relates to electromagnetic relays and more particularly to electromagnetic relays including a coil with coil body and wending; an L-shaped core whose longitudinal leg is arranged axially in the coil body and whose transverse leg lies perpendicular thereto at a first face of the coil; an L-shaped armature which forms an air gap with one end opposite a first end of the core, and which is mounted with its other end at the second end of the core such that, given a closed air gap, core and armature approximately form a rectangle, wherein a magnet system is formed by coil, core and armature; a basic element of insulating material which is connected with the magnet system at the side of the coil opposite the armature and in which the basic element includes at least one stationary contact element and at least one contact spring that cooperates therewith as a moving contact element and wherein the contact elements are respectively connected to terminal elements; and a slide transferring the armature motion to the at least one contact spring.

BACKGROUND OF THE INVENTION

DE 1 764 256 A1 describes a relay generally of the abovementioned type. In this relay, the pull-back spring for the armature is arranged between coil body and the inner side of the longitudinal leg of the armature, and an additional device for securing the armature is necessary.

EPO 319 478 B1 teaches an electromagnetic relay which serves the switching of a plurality of mutually independent contact groups. In this relay, the transfer of the armature motion to the contact elements is carried out via a U-shaped slide. At the upper end of its longitudinal leg, the slide is hooked in directly to the longitudinal leg of the armature via snap latches. The longitudinal legs of the slide therein have sufficient flexibility to enable the snapping mechanism. However, the elasticity of the longitudinal leg of the slide appears disadvantageous with reference to the mechanical stability of the relay. The bearing of the armature and the securing of the armature spring is performed exclusively at the coil body. A flat structural form can thereby be realized, admittedly while making allowance for a quite protruding width.

SUMMARY OF THE INVENTION

The object of the invention is to provide a relay which is suitable for automated assembly and which enables a simplified assembly of the armature spring and of the armature as well as an improved suspension of the slide, so that the slide diverts the armature motion without interfering with the contact element. Furthermore, the compact structural form as well as the modular construction of the relay of the present invention facilitate an automatized production thereof.

The object is inventively achieved, in that the armature—with its transverse leg—is mounted in an unrollable fashion at the free end of the longitudinal leg of the core, that, at the end of its longitudinal leg, this armature forms a working air gap with the end of the transverse leg of the core, and that a U-shaped armature spring is provided which is secured on the longitudinal leg of the armature with a first arm, is arranged approximately parallel to the transverse leg of the armature in the central portion, and is secured—parallel to the longitudinal leg of the core—in a recess between core and coil body with a second arm.

In an advantageous development, the recess between core and coil body takes the form of an offset free space at the coil body. This can be easily realized in the production of the coil body, since the coil body is preferably produced as plastic molded part. Relative to this, the integration of the recess in the core is considerably more costly. In an advantageous development, the second arm of the armature spring—this arm being inserted between coil body and core—is provided with a snap latch hooked to the core. An unintentional detachment of armature spring—including, on the one hand, the armature connected securely therewith, and on the other hand, coil body with core arranged therein—is thereby not possible without great difficulty. The snap latch is preferably manufactured by stamping from the spring sheet and subsequent bending, so that, positively and non-positively, it fits the slot located in the core. In this connection, it is to be seen as an advantage that no other securing means or assembly steps are necessary for the securing of the armature, apart from embossed rivet buttons through which armature and armature spring are preferably mutually connected.

Furthermore, the at least one contact spring is arranged parallel to the coil axis, wherein a U-shaped slide—coupled at the armature via the ends of the side arms of the slide—actuates with its central portion the at least one contact spring, this resulting in a compact structural form, particularly for multipolar relays. The coupling of the slide at the armature is simplified by a further advantageous development of the invention via snap latches or spring tabs formed at the ends of the side arms of the slide. To this end, spring tabs are formed in one piece at the armature spring at both sides—preferably oriented perpendicular to the longitudinal leg of the armature—at which spring tabs are securely hooked. The free ends of the spring tabs are prestressed relative to the hook-shaped snap latches—preferably through another bending of the ends—so that, at both sides, a respective stop shoulder of the side arm of the slide is pressed against the longitudinal leg of the armature. This achieves a carrying of the slide—without play—given the armature motion. The advantage further consists in the fact that neither the armature nor the slide must be elastic, so that the mechanical stability of the relay is increased.

Furthermore, the base element is fitted with insertion pockets for accepting, preferably, a plurality of contact assemblies consisting of a contact spring and counter contact elements. The individual contact assemblies are insulated from one another by the sidewalls of the insertion pockets. Furthermore, downwardly directed actuation elements are formed at the lower edge of the central portion of the slide. The number of the actuation elements corresponds to the number of the contact assemblies to be switched. This results in a saving of space, since the actuation elements are already accommodated in the insertion pockets, as opposed to a massive design of the central portion of the slide. In addition, sidewalls of the insertion pockets which are sufficiently high for insulating the contact assemblies can be realized in this way with compact structural shape of the relay. Besides this, the excess stroke of the contact springs with reference to the counter contact elements can be defined by the height of the actuation elements. The actuation elements are easily formed at the slide, which is preferably produced as plastic molded part.

Furthermore, for improving the guidance of the slide at the armature, two guide latches for the side arms of the slide are respectively provided at the spring tabs at both sides in the region of the suspension of the slide. These guide latches wrap around the side arms of the slide and thus secure this against lateral displacement, whereby the unhinging of the slide from the spring tabs is prevented. An additional guidance of the center portion of the slide is given by recesses in the basic element which are formed in the sidewalls of the insertion pockets. Together with the features already cited, a very precise guidance of the slide given armature motion is realized.

The holding journals integrated at the lower edge of the transverse armature leg further contribute towards increasing the mechanical stability of the relay. These journals wrap around the core in a positively locking fashion and thus securing the armature against lateral displacement. Furthermore, a pair of guide elements formed at the upper edge of a coil body flange fixate the longitudinal leg of the armature, whereby the stability of the arrangement is increased with low extra expenditures of a production-technical nature.

A very simple course of assembly results from the cited advantageous constructive features of the inventive relay, which can additionally be effected without great expenditure in terms of tools and without specialized labor. The basic element is assembled with the contact elements and terminal elements preferably at the same time as the assembly of the magnet system. The armature spring is preferably secured at the armature beforehand, e.g. by riveting. In the assembly of the magnet system, the core is preferably pushed axially into the coil body first, until the transverse leg of the core lies adjacent at a face of the coil body. Afterwards, the arm of the armature spring which contains the snap latch is inserted into the recess between coil body and core, until the snap latch hooks securely in the slot or recess provided in the core. The slide is then appropriately hung at the armature spring tabs from below, the assembly of the magnet system including the coupling of the slide being thus concluded. In the last assembly step, the magnet system and basic element are merely connected with each other.

Other objects and advantages of the invention will become apparent upon reading the following detailed description and appended claims, and upon reference to the accompanying drawings.

BRIEF DESCRIPTION OF THE DRAWINGS

The Invention is subsequently further detailed in exemplifying embodiments using the drawing. In the drawing.

From the above description it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

DETAILED DESCRIPTION OF THE PRESENTLY PREFERRED EMBODIMENTS

Figure 1:
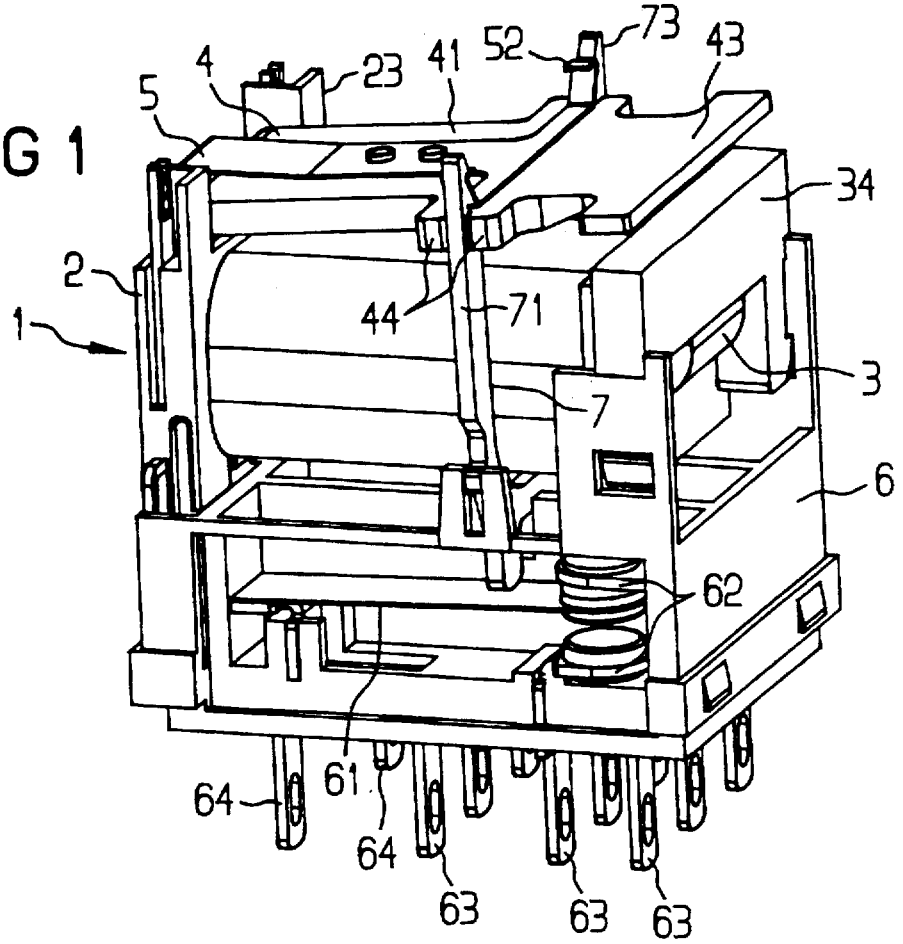
FIG. 1 is a perspective view of an inventive relay in tripolar embodiment.

In its principal components, as shown in FIG. 1, the inventive relay consists of a magnet system 1, a slide 7 suspended at the armature spring tabs 52, and a base element 6 as well as contact springs 61, counter contact elements 62, contact terminal elements 63, and winding terminal elements 64. Preferably, a sufficiently high prestressing of the contact spring 61 is provided, particularly relative to the upper counter contact element 62 serving as break, in order to guarantee high pull-off forces with reference to the lower counter contact element 62, whereby a permanent welding of the contacts is prevented. Furthermore, at a coil body flange 22 (see FIG. 2), a pair of angular guide elements 23 (see FIG. 1) is formed which extend upwardly and which retain the armature 4 laterally, thereby increasing the shock resistance of the relay.

Figure 2:
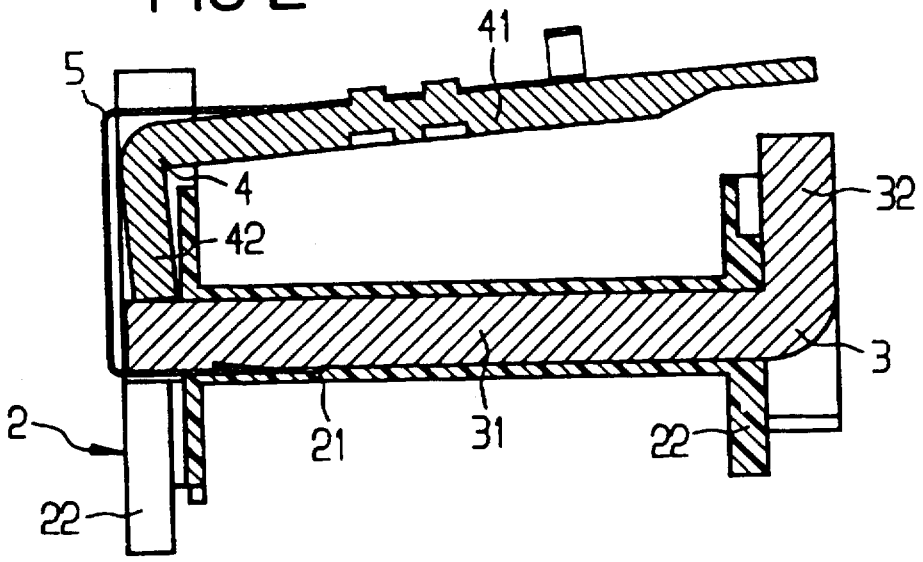
FIG. 2 is a sectional view of an inventively formed magnet system shown in FIG. 1 without winding.
Figure 3:
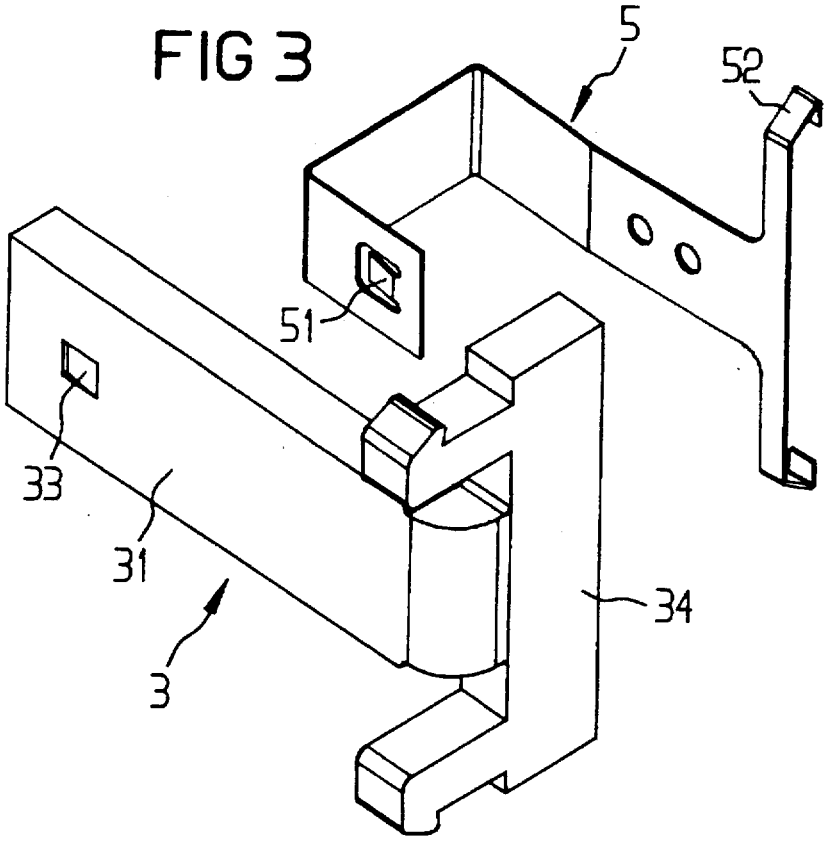
FIG. 3 is a perspective view of an armature spring and a core with inventive features first shown in FIG. 1.
Figure 4:
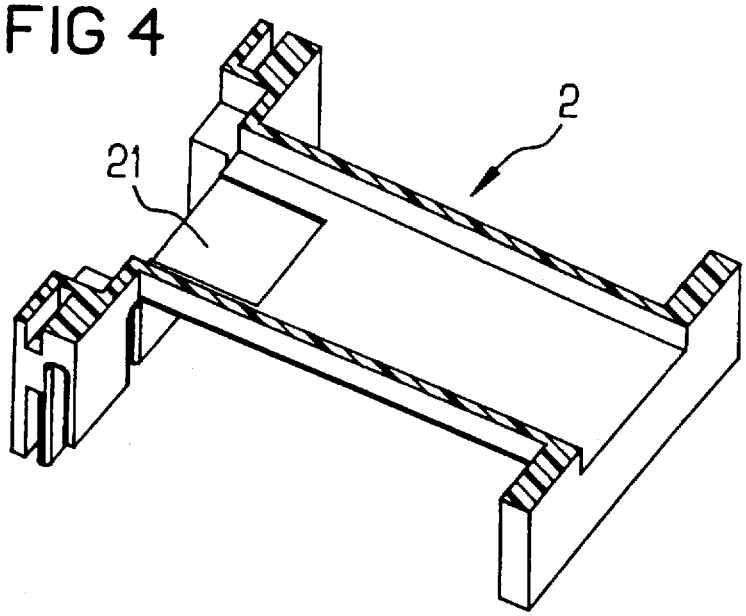
FIG. 4 is a perspective view of a coil body first shown in FIG. 1 which is cut open; and, FIG. 5 is a perspective view of a slide suspended at an armature spring and connected with an armature.

FIG. 2 illustrates the inventive features of the magnet system 1 which serve to secure the armature spring 5. In the coil body 2, a flat area 21 is provided as shown in FIG. 4. This area 21 accepts the arm of the armature spring 5 which contains the snap latch 51 and extends parallel to the transverse leg 42 of the armature. The arm of the armature spring 5 which is fitted with the snap latch 51 is pushed in until immediately before the stop formed by the area 21 in the coil body 2, and in this position, the snap latch 51 is hooked into the slot 33 at the lower side of the core 3 (see FIG. 3). Furthermore, as shown in FIG. 3, a yoke 34 is formed in one piece at the transverse leg 32 (FIG. 2) of the core 3. To reduce the leakage flux at the working air gap, yoke 34 and pole face 43 are widened in a T shape. The armature spring 5 is fitted with a prestressing bend through which the armature 4 is prestressed in the direction of the yoke 34.

Figure 5:
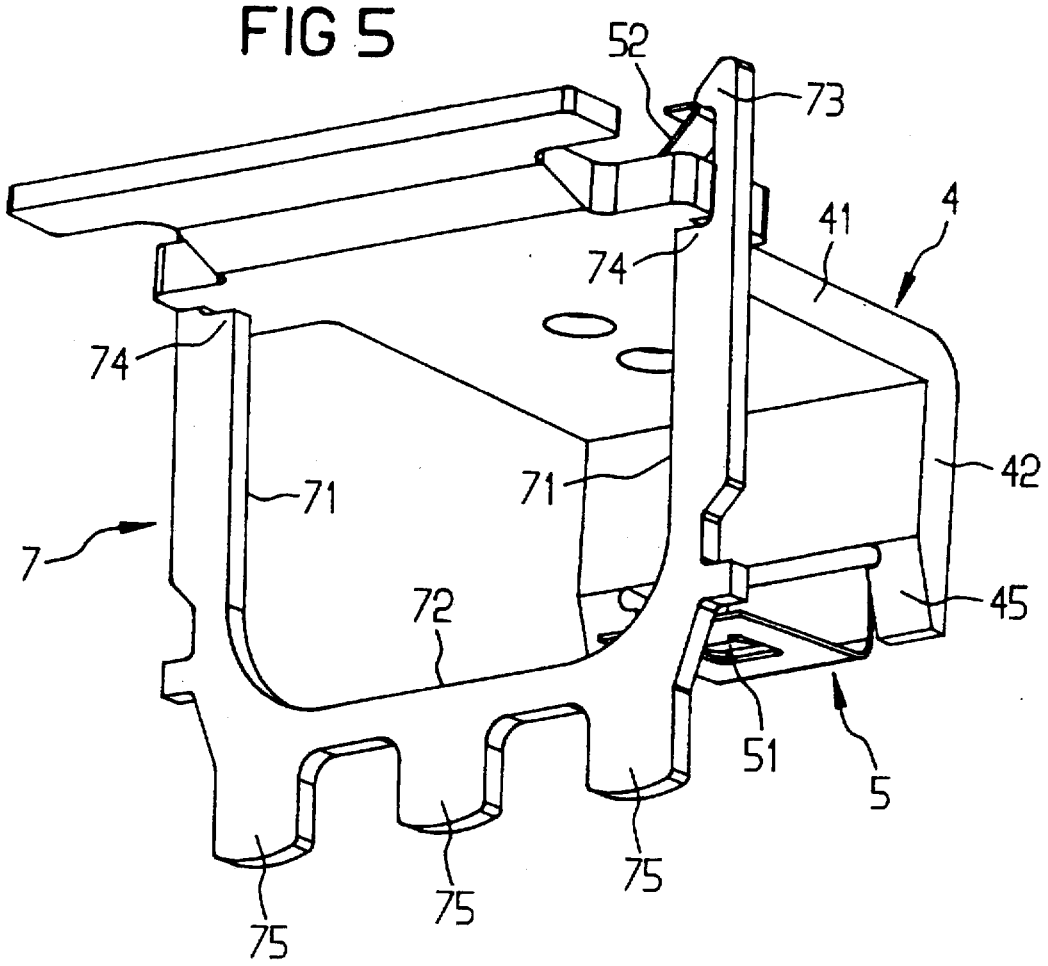

The suspension mechanism for the slide 7 is depicted in FIG. 5. For reasons of a better overview, the reproduction of coil body, core and basic element is forgone. At the upper side of the armature spring 5 at its free ends, spring tabs 52 are formed at both sides which are oriented at their free end perpendicularly to the main axle of the armature spring 5, wherein the spring tabs 52 are bent first in an obtuse angle and then once more, immediately at the end, in an acute angle, so that the ends of the spring tabs 52 comprise a prestressing (see FIG. 1). The spring tabs engage the lower edge of the snap latches or hooks 73 formed at the ends of the side arms 71 of the slide 7, whereby the stop shoulders 74 of the side arm 71 are pressed against the lower side of the longitudinal leg 41 of the armature. The side arms 71 of the slide 7 are received between a pair of guide latches 44 formed at the flank of the longitudinal leg 41 of the armature, these latches wrapping around the ends of a side arm 71 in order to prevent a lateral displacement of snap latches 73 and spring tabs 52 towards each other. The unhinging of the slide 7 is thus simultaneously prevented. Furthermore, holding journals 45, constructed at the lower edge of the transverse leg 42 of the armature, are recognizable in FIG. 5, these holding journals being formed at the outer edges of the transverse leg of the armature 42, so that they wrap around the core positively and additionally secure the armature 4 laterally. Furthermore, actuation elements 75 are attached at the slide 7 at the lower edge of the central portion 72. The slide 7 is fitted with three actuation elements 75, as this exemplifying embodiment concerns a slide 7 for a tripolar relay.

A very compact constructional form for a multipolar relay results from the features represented here. For complete metal protection of the relay, a protective cap of insulating material is placed on over the arrangement consisting of magnet system 1 and base 6 from above—this not begin explicitly depicted here in the framework of the exemplifying embodiments.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

We claim:

1. An electromagnetic relay comprising:

a magnet system comprising a coil wrapped around a coil body having first and second opposing ends, an L-shaped core comprising a longitudinal leg and a transverse leg, and an L-shaped armature comprising a longitudinal leg and a transverse leg, the coil body being hollow and accommodating the longitudinal leg of the core axially therethrough with a free end of the longitudinal leg of the core extending past the second end of the coil body and a proximate end of the longitudinal leg of the core being connected to the transverse leg of the core which extends perpendicularly along the first end of the coil body, the transverse leg of the armature extending perpendicularly along the second end of the coil body and engaging the free end of the longitudinal leg of the core, the longitudinal leg of the armature being connected to the transverse leg of the armature and extending outside of the coil and comprising a distal end which forms a working air gap between the distal end of the longitudinal leg of the armature and the transverse leg of the core, the core and armature approximately forming a rectangle, the coil body being connected to a base element comprising insulating material, the coil being disposed between the base element and the longitudinal leg of the armature, the base element being connected to a stationary contact element and a contact spring, the contact spring being connected to the armature by a slide which transfers movement of the armature to the contact spring, the armature being held in place by a U-shaped armature spring comprising a central portion disposed between first and second arms, the first arm being disposed on top of the longitudinal leg of the armature with the longitudinal leg of the armature being disposed between the coil and the first arm of the armature spring, the second arm of the armature spring being disposed between the longitudinal leg of the core and the coil body, the central portion of the armature spring extending parallel to the transverse leg of the armature with the transverse leg of the armature being trapped between the central portion of the armature spring, the second end of the coil body and the free end of the longitudinal leg of the core.

2. The relay of claim 1 wherein the coil body comprises a recess for accommodating the second arm of the armature spring.

3. The relay of claim 1 wherein the second arm of the armature spring comprises a spring latch that engages a slot disposed in the longitudinal leg of the core to secure the second arm of the armature spring to the longitudinal leg of the core.

4. The relay of claim 1 wherein the contact spring extends parallel to the coil axis and between the coil and the base element, the slide being U-shaped and comprising a central portion that engages the contact spring and two opposing side arms that extend along opposing sides of the magnet system and that are connected to opposing sides of the longitudinal leg of the armature.

5. The relay of claim 4 wherein the side arms each comprise distal ends having a latch that is coupled to the longitudinal leg of the armature.

6. The relay of claim 5 the armature spring comprises two opposing spring tabs, each spring tab being disposed between the latch of one of the side arms of the slide and the longitudinal leg of the armature.

7. The relay of claim 6 wherein each side arm comprises a slot disposed below its respective latch and above a stop shoulder, the longitudinal leg of the armature being received in slot of each side arm, the spring tabs of the armature spring pressing the longitudinal leg of the armature onto the stop shoulder of each side arm.

8. The relay of claim 4 wherein the central portion of the slide comprises an actuation element extending downward therefrom and passing through the base element.

9. The relay of claim 4 wherein opposing sides of the longitudinal leg of the armature each comprise a slot disposed between a pair of guide latches, each slot for accommodating one of the side arms of the slide.

10. The relay of claim 1 wherein the transverse leg of the armature comprises a lower end comprising a recess disposed between a pair of holding journals, the recess for accommodating the free end of the core.

11. The relay of claim 1 the second end of the coil body comprises and upwardly extending flange which comprises a recess disposed between a pair of guide elements, the recess for accommodating the armature.

12. An electromagnetic relay comprising:

a magnet system comprising a coil wrapped around a coil body, an L-shaped core comprising a longitudinal leg that extends axially through the coil body and a transverse leg, and an L-shaped armature comprising a longitudinal leg and a transverse leg, the longitudinal leg of the core and the longitudinal leg of the armature being disposed generally parallel to one another and the transverse leg of the core and the transverse leg of the armature being disposed generally parallel to one another so that the core and armature form a rectangle, the coil body being connected to a base element, the coil being disposed between the base element and the longitudinal leg of the armature, the base element being connected to a stationary contact element and a contact spring, the contact spring being connected to the armature by a U-shaped slide which transfers movement from the armature to the contact spring, the armature being held in place by a U-shaped armature spring comprising a central portion disposed between first and second arms, the first arm being disposed on top of the longitudinal leg of the armature with the longitudinal leg of the armature being disposed between the coil and the first arm of the armature spring, the second arm of the armature spring being disposed between the longitudinal leg of the core and the coil body, the central portion of the armature spring extending parallel to the transverse leg of the armature with the transverse leg of the armature being trapped between the central portion of the armature spring, the second end of the coil body and the longitudinal leg of the core.

13. The relay of claim 12 wherein the coil body comprises a recess for accommodating the second arm of the armature spring.

14. The relay of claim 12 wherein the second arm of the armature spring comprises a spring latch that engages a cooperating slot disposed in the longitudinal leg of the core to secure the second arm of the armature spring to the longitudinal leg of the core.

15. The relay of claim 12 wherein the contact spring extends parallel to the coil axis and between the coil and the base element, the slide being U-shaped and comprising a central portion that engages the contact spring and two opposing side arms that extend along opposing sides of the magnet system and that are connected to opposing sides of the longitudinal leg of the armature.

16. The relay of claim 15 wherein the side arms each comprise distal ends having a latch that hooked to the longitudinal leg of the armature.

17. The relay of claim 16 the armature spring comprises two opposing spring tabs, each spring tab being disposed between one of the latches of the side arms of the slide and the longitudinal leg of the armature.

18. The relay of claim 17 wherein each side arm comprises a slot disposed below its respective latch and above a stop shoulder, the longitudinal leg of the armature being received in slot of each side arm, the spring tabs of the armature spring pressing the longitudinal leg of the armature onto the stop shoulder of each side arm.

19. The relay of claim 12 wherein opposing sides of the longitudinal leg of the armature comprise a slot disposed between a pair of guide latches, each slot for accommodating one of the side arms of the slide, and wherein the transverse leg of the armature comprises a lower end comprising a first recess disposed between a pair of holding journals, the first recess for accommodating the longitudinal leg of the core, and the second end of the coil body comprises and upwardly extending flange which comprises a second recess disposed between a pair of guide elements, the second recess for accommodating the armature.

20. An electromagnetic relay comprising:

a magnet system comprising a coil wrapped around a coil body having first and second opposing ends, an L-shaped core comprising a longitudinal leg and a transverse leg, and an L-shaped armature comprising a longitudinal leg and a transverse leg, the coil body being hollow and accommodating the longitudinal leg of the core axially therethrough with a free end of the longitudinal leg of the core extending past the second end of the coil body and a proximate end of the longitudinal leg of the core being connected to the transverse leg of the core which extends perpendicularly along the first end of the coil body, the transverse leg of the armature extending perpendicularly along the second end of the coil body and engaging the free end of the longitudinal leg of the core, the longitudinal leg of the armature extending outside of the coil and comprising a distal end which forms a working air gap between the distal end of the longitudinal leg of the armature and the transverse leg of the core, the core and armature approximately forming a rectangle, the coil body being connected to a base element comprising insulating material, the coil being disposed between the base element and the longitudinal leg of the armature, the base element being connected to a stationary contact element and a contact spring, the contact spring being connected to the armature by a slide which transfers movement of the armature to the contact spring, the contact spring extending parallel to the coil axis and between the coil and the base element, the slide being U-shaped and comprising a central portion that engages the contact spring and two opposing side arms that extend along opposing sides of the magnet system and that are coupled to opposing sides of the longitudinal leg of the armature and which connect the first arm of the armature spring to the longitudinal leg of the armature, the armature being held in place by a U-shaped armature spring comprising a central portion disposed between first and second arms, the first arm being disposed on top of the longitudinal leg of the armature with the longitudinal leg of the armature being disposed between the coil and the first arm of the armature spring, the second arm of the armature spring being disposed between the longitudinal leg of the core and the coil body, the coil body comprises a recess for accommodating the second arm of the armature spring, the second arm of the armature spring comprises a spring latch that engages a slot disposed in the longitudinal leg of the core to secure the second arm of the armature spring to the longitudinal leg of the core, the central portion of the armature spring extending parallel to the transverse leg of the armature with the transverse leg of the armature being trapped between the central portion of the armature spring, the second end of the coil body and the free end of the longitudinal leg of the core, opposing sides of the longitudinal leg of the armature further comprising a slot disposed between a pair of guide latches, each slot for accommodating one of the side arms of the slide, the transverse leg of the armature comprising a lower end comprising a first recess disposed between a pair of holding journals, the first recess for accommodating the free end of the core, the second end of the coil body comprising and upwardly extending flange which comprises a second recess disposed between a pair of guide elements, the second recess for accommodating the armature.

* * * * *